US005924425A

United States Patent [19]

Luedecke

[11] Patent Number: 5,924,425

[45] Date of Patent: Jul. 20, 1999

[54] PORTABLE REPOSITORY FOR SPENT SMOKING MATERIALS

[76] Inventor: Carol S. Luedecke, 709 Bayou Dr., Destin, Fla. 32541

[21] Appl. No.: 09/102,421

[22] Filed: Jun. 22, 1998

Related U.S. Application Data

[60] Provisional application No. 60/050,645, Jun. 24, 1997.

[51] Int. Cl.[6] ..... A24F 19/00

[52] U.S. Cl. ..... 131/231; 131/242; 206/246

[58] Field of Search ..... 131/231, 240.1, 131/241, 242, 242.6; 206/246

[56] References Cited

U.S. PATENT DOCUMENTS

| | | | |
|---|---|---|---|
| D. 258,468 | 3/1981 | Whitlock | D27/14 |
| 1,504,310 | 3/1924 | Backus . | |
| 2,152,285 | 6/1939 | Schirmer | 131/51 |
| 2,595,103 | 11/1952 | Schmaling | 131/242 |
| 3,283,938 | 11/1966 | Vidal | 220/20.5 |
| 4,142,537 | 3/1979 | Fenelon | 131/240 |
| 4,634,014 | 1/1987 | Carr | 220/1 H |
| 5,617,880 | 4/1997 | Landuydt | 131/237 |

OTHER PUBLICATIONS

Bobken Self Extinguisher—Sanco Products, Oklahoma City, OK.

Safety Cans—Eagle—Manufacturing Company Wellsburg, West Virginia.

Justrite "Cease–Fire" Waste receptacles—lab Safety Supply–P. 555.

*Primary Examiner*—Stanley S. Silverman
*Assistant Examiner*—Steven Leavitt
*Attorney, Agent, or Firm*—Womble Carlyle Sandridge & Rice; Louis T. Isaf

[57] ABSTRACT

This invention is an improved portable repository for spent smoking materials. The portable repository has a hollow rigid body with an open upper end and a closed lower end, and a cavity formed between the upper and lower ends. The portable repository includes a cover which has a selectively moveable closure and which is selectively detachable from the upper end of the body, and a baffle which has a narrow aperture therethrough and which is positioned between the cover and the upper end of the body. Spent smoking materials are inserted through the selectively moveable closure of the cover and the aperture of the baffle to be retained within the cavity of the body. The cover, baffle, and upper end of the body are fitted together to form a sandwiched joint and seal to prevent smoke from the spent smoking materials retained within the cavity from escaping into the environment or air entering the cavity and fostering combustion. The storage and disposal of spent smoking materials using the portable repository is achieved by opening the selectively moveable closure of the cover, and placing spent smoking materials within the selectively moveable closure and through the aperture of the baffle to be retained within the cavity of the body. When it is desired to dispose of the spent smoking materials contained within the portable repository, the cover is selectively detached form the upper end of the body, and the spent smoking materials retained within the cavity of the body are emptied therefrom.

26 Claims, 4 Drawing Sheets

PORTABLE REPOSITORY FOR SPENT SMOKING MATERIALS

CROSS-REFERENCE TO RELATED APPLICATION

This application claims the benefit of U.S. Provisional Application No. 60/050,645, filed Jun. 24, 1997.

BACKGROUND OF THE INVENTION

1. Field of the Invention

The present invention generally relates to containers for the collection of spent smoking materials, and more particularly, to ones of such containers which are readily portable.

2. Description of the Related Art

When ignited, tobacco products such as cigars and cigarettes, generate ash and produce an unused remnant, or "butt", which a smoker must dispose of. In recent years, there has been significant public opposition to smoking in general, which has led to prohibition of smoking in such places as restaurants, nightclubs, hotels, airlines, and the workplace and led to the removal of many receptacles for tobacco ashes and remnants. In many places, smokers are now forced to go outside to smoke and sometimes are limited to only specific outdoor locations away from buildings. Moreover, many public places do not place ashtrays or other receptacles for tobacco product ashes and remnants for the express purpose of dissuading persons from smoking. Additionally, many auto makers no longer build cars having ashtrays, to dissuade smoking while driving.

Thus, because of this opposition to smoking, many smokers are forced to take along containers with them to collect the tobacco product ashes and remnants when they go to the outdoor areas to smoke, or within vehicles which do not have ashtrays. Such containers are generally simple ashtrays or cups (or even soda cans), used solely to collect the ashes and tobacco product remnants, and which, among other problems, do not prevent the smoke from the spent smoking materials from dissipating into the environment, and/or do not conceal the unsightly spent smoking materials, and/or cannot be emptied, and/or are not reusable. Alternatively, a smoker may forego the use of any container and instead put the ashes on the ground and otherwise dispose of the tobacco remnant into the environment. Such action is certainly deleterious to the environment and allows smoke from the remnants of the tobacco products to dissipate into the environment, often subjecting others to the tobacco smoke. It is in response to the foregoing problems that the present invention is primarily directed to address.

SUMMARY OF THE INVENTION

Briefly described, the present invention comprises a portable repository for spent smoking material which includes a smoking material receiver, a cover having a selectively moveable closure, and a baffle. In accordance with one preferred embodiment thereof, the smoking material receiver comprises a hollow rigid body having an open top end and a closed bottom end and defining a cavity within the body, the cover includes a selectively moveable closure and fits about the upper end of the body and selectively detaches therefrom; and the baffle includes an aperture therethrough and is positioned between the cover and the lower end of the body, such that spent smoking materials inserted through the moveable closure of the cover and the aperture of the baffle are retained within the cavity of the body.

The body, alternately, further includes an L-shaped extension which allows the body to be selectively attached to a vertical planar extension, such as a belt. Further, in the preferred embodiment, a lower end portion of the body is cylindrical in shape and of a diameter which fits within a standard beverage container holder of the type currently found in automobiles, while an upper end portion is of a larger diameter to provide expanded capacity for the body cavity to contain spent smoking materials.

The baffle is preferably downwardly infundibular with the aperture at the lowermost point of the baffle. The infundibular shape of the baffle assists in having the spent smoking materials directed through the aperture into the cavity of the body with the assistance of gravity, and inhibits the escape of smoke from the cavity.

The portable repository is further provided, in its preferred embodiment, with one or more support members by which a tobacco product is accessibly positioned within the selectively moveable closure. The support member is preferably a V-shaped notch.

In accordance with the preferred embodiment, a three-layer, sandwiching joint and seal removably attaches the cover and the baffle to the upper end of the body. The sandwiching joint and seal assist in preventing smoke from the cavity from escaping into the environment and retards the ingress of air which supports combustion of smoldering smoking materials in the cavity.

In use, the portable repository for spent smoking materials, in the preferred embodiment above, is provided to a smoker prior to smoking a tobacco product. The smoker then opens the selectively moveable closure of the cover, and places spent smoking material within the open closure and through the aperture of the baffle to be retained within a cavity of a body. The smoker then selectively detaches the cover and the baffle from the upper end of the body and empties the cavity of the spent smoking materials retained therein. If the portable repository is provided with a member for supporting tobacco products, such as the V-shaped notch, then the method of use of the portable repository includes the step of placing a tobacco product on the member for supporting tobacco products such as spent smoking material from the tobacco product falls through the aperture of the baffle into the cavity of the body.

It is therefore the primary object of the present invention to provide a portable repository for spent smoking materials which internally retains spent smoking materials, retards smoke from the spent smoking materials from escaping into the environment and retards the ingress of air into the cavity to foster combustion of smoldering smoking materials in the cavity.

It is another object of the present invention to provide a portable repository for spent smoking materials which selectively attaches to a belt, pocket, or other vertical planar extension whereby the portable repository is easily transportable.

It is a further object of the present invention to provide a portable repository which is adapted to fit within a standard beverage container holder.

It is yet another object of the present invention to provide a portable repository which includes a member for supporting a tobacco product such that spent material from the supported tobacco product falls within the cavity of the repository.

It is yet a further object of the present invention to provide a portable repository from which spent smoking materials retained within the repository is selectively emptied therefrom.

These and yet other objects and advantages of the present invention will become apparent after review of the hereinafter set forth Brief Description of the Drawings, Detailed Description of the Preferred Embodiment, and the claims.

DETAILED DESCRIPTION OF THE PREFERRED EMBODIMENT

Figure 1:
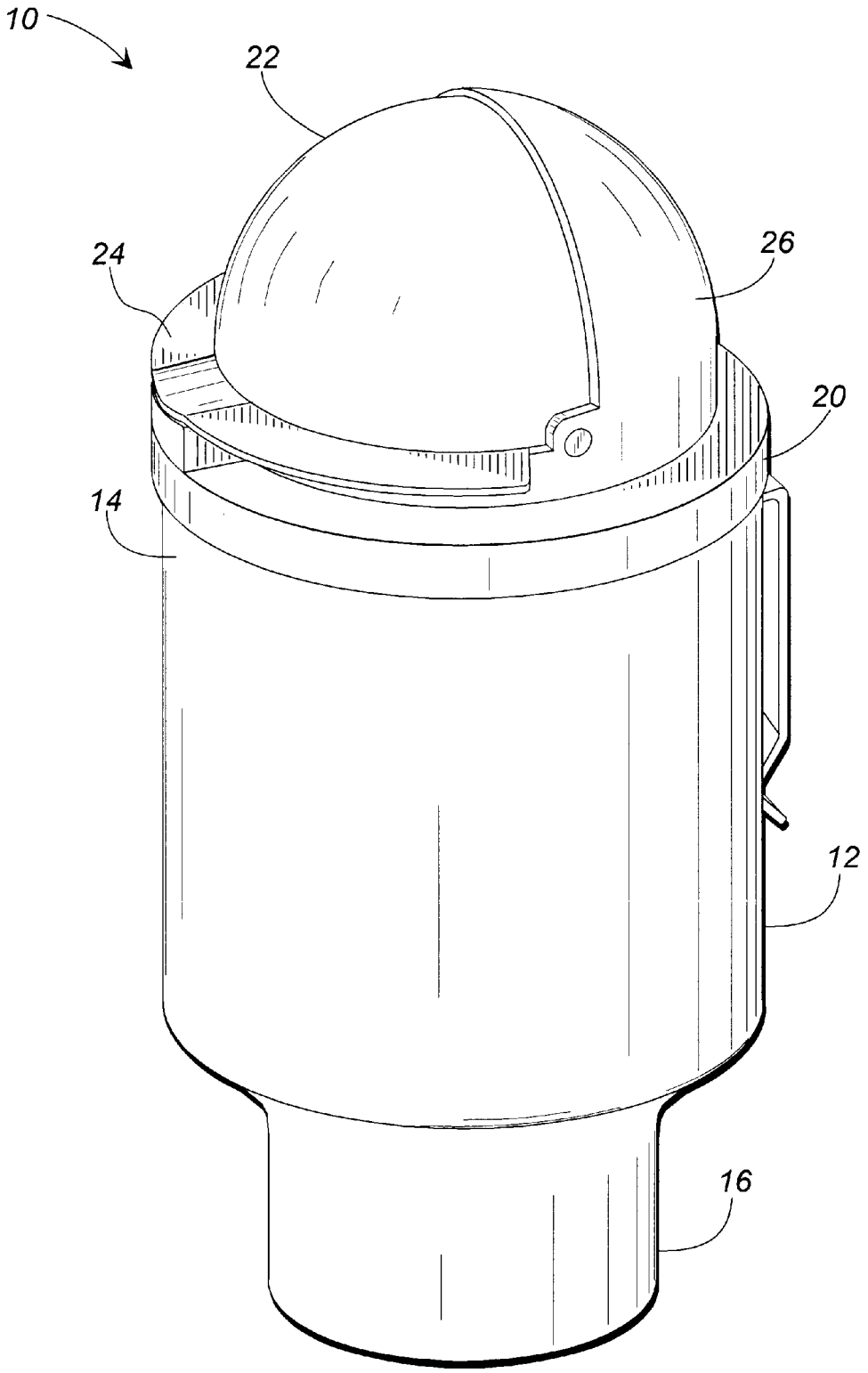
FIG. 1 is a perspective view of the preferred embodiment of the portable repository for spent smoking materials.
Figure 3:
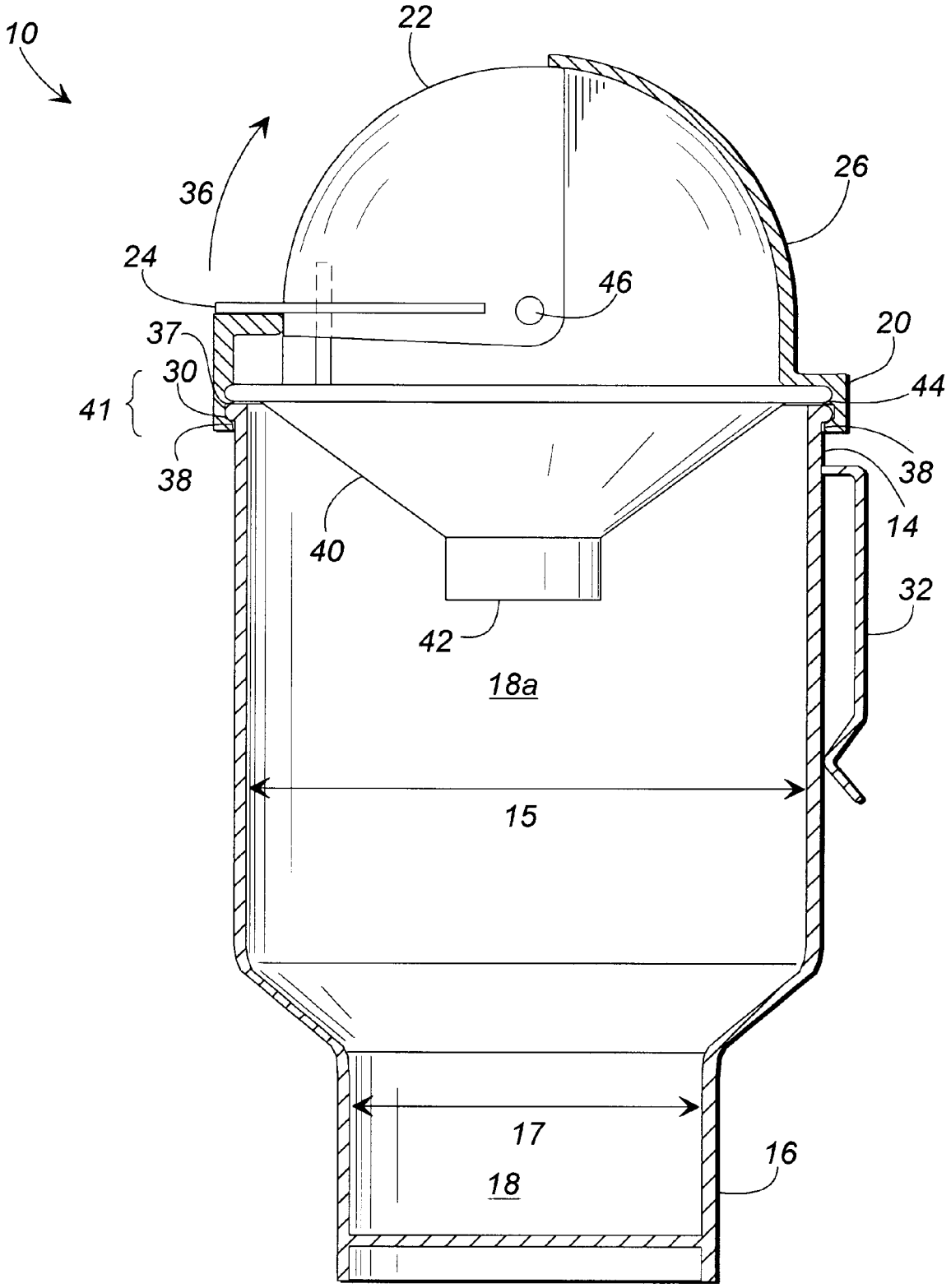
FIG. 3 is a side cross-sectional view of the portable repository for spent smoking materials illustrating the sandwiching joint and seal of the body baffle, and cover.

Referring now in more detail to the drawings, in which like numerals represent like components within the several views, FIG. 1 illustrates a perspective view of the portable repository 10 for spent smoking materials which embodies the principles of this invention in a preferred form. The portable repository 10 is comprised of a smoking material repository, preferably in the form of a rigid body 12 having an open top end 14 and a closed bottom end 16. A cavity is formed 18 within the body 12, as shown in FIG. 3. A cover 20 fits about the open upper end 14 of the body 12, and includes a selectively moveable closure 22. As shown in FIG. 3, a baffle 40 is attached to top end 14 of the body 12 and spans across the diameter 15 to define a materials collection zone 18*a* within the cavity and below the aperture 42 of the baffle 40.

Figure 2:
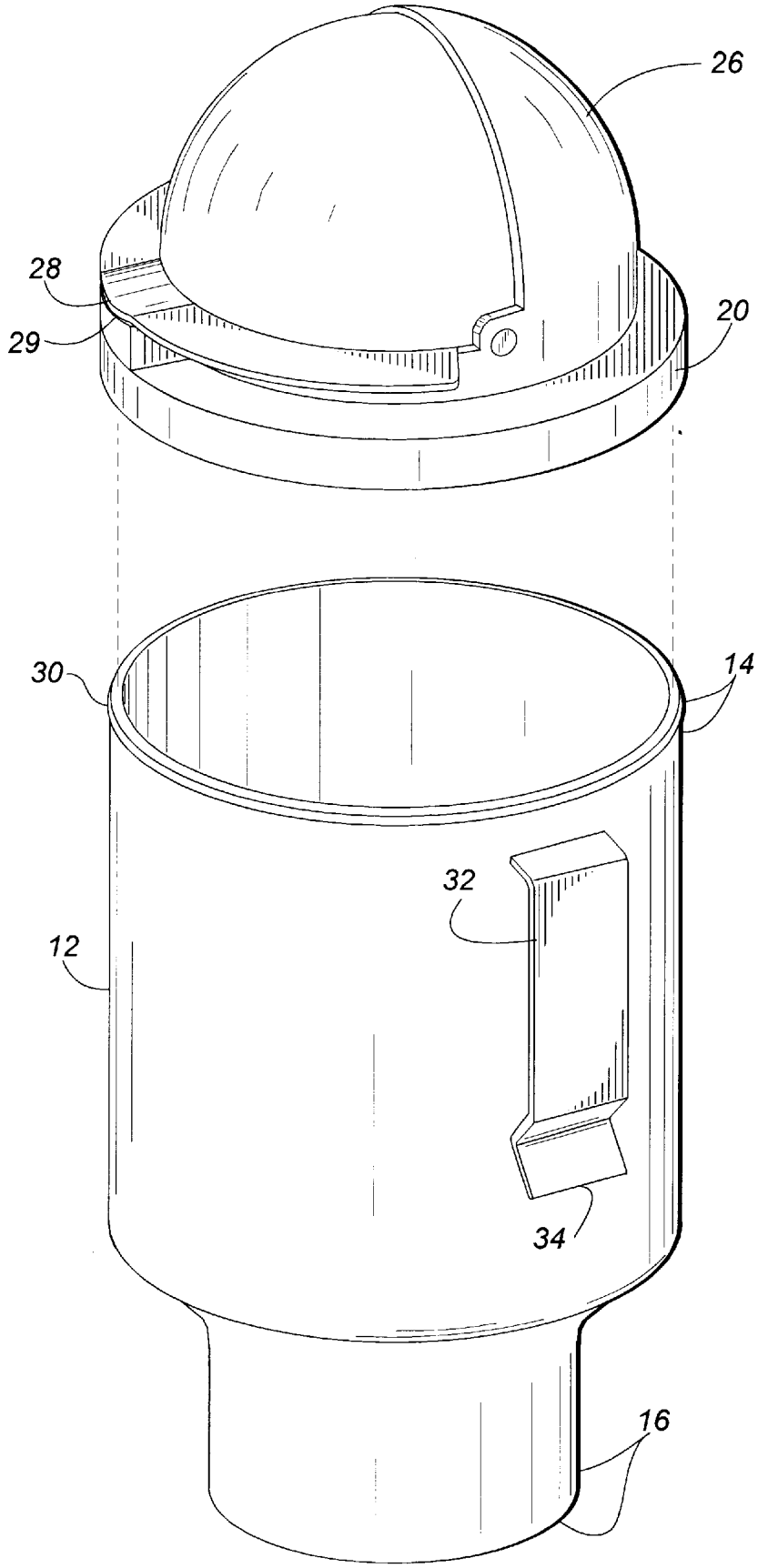
FIG. 2 is a perspective view of the portable repository for spent smoking materials illustrating the cover selectively detached from the upper end of the body.
Figure 4:
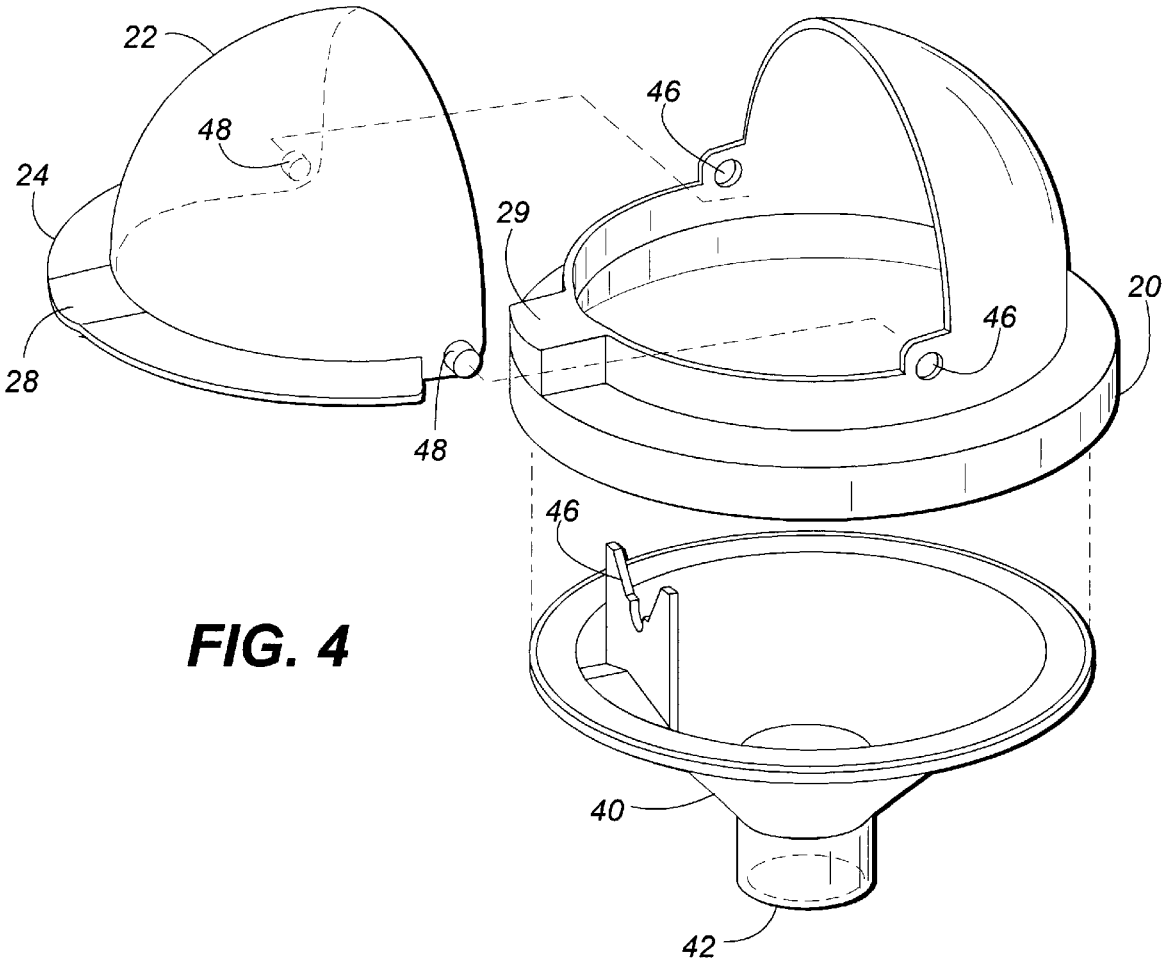
FIG. 4 is an exploded view of the selectively moveable closure, the hemispherical portion of the cover, and the baffle.

The rigid body 12, cover 20, and baffle 40 are preferably molded from a thermo-plastic, although other rigid, fire-resistant materials are acceptably used, such as metals or acrylics. However, a minimal amount of flexibility is desirous with the preferred embodiment due to the functioning of the snap-fitting joint and seal (discussed in more detail below) by which the cover 20 and baffle 40 are joined about an outer lip 30 on the top end 14 of the body 12, as shown in FIG. 2. Further, some degree of flexibility is also desired in embodiments in which the selectively moveable closure 22 is embodied as rotatably snap-fitting within eyelets 46, as shown in FIG. 4, of the hemispherical portion 26 of the cover 20.

The rigid body 12 is alternately embodied as including an L-shaped extension 32 for selective attachment upon a vertically planar extension, outwardly extending from the body 12. The L-shaped extension is shown as having a lower curved portion 34 which assists in the L-shaped extension 32 sliding over a vertically planar projection, such as a belt or a pocket. It should be apparent that other structures may be used projecting from the body 12 such that the portable repository for spent smoking materials 10 may attach to a variety of surfaces and projections, including but not limited to hooks, hooks for mating with loops (Velcro), suction cups, and clips.

The body 12 is preferably shaped having an upper diameter 15 and lower smaller diameter 17 such that the portable repository for spent smoking materials 10 may slidably fit within a standard beverage container holder which normally receives the lower ends of cans and cups. Such beverage container holders are normally rings or other tubular structures found within automobiles, armrests of various seats, and in various public fora and, by way of example, have a diameter of 2–3 inches, and thus, the lower smaller diameter 17 of exemplary embodiments is likewise in such range. Because of the desirability of the lower end 16 of the body 12 to fit within standard beverage container holders, the body 12 is preferably cylindrical, although other shapes and dimensions of the body 12 may be used, with or without being frusto-conical, tapered or otherwise having a shaped lower end 16 to fit within the standard beverage container holder.

As shown in FIGS. 2 and 3, the cover 20 preferably has a hemispherical portion 26 projecting upwardly, and a selectively moveable closure 22 is selectively slid within hemispherical portion 26 by directly protruding edge 24 in the direction of arrow 36. The selectively moveable closure 22 includes a protruding edge 24 which has a notch 28 complimentary to a notch 29 of the cover 20, such that the selectively moveable closure 22 is frictionally held from horizontal motion by the interaction of the notches 28 and 29 when the protruding edge 24 is resting upon the cover 20. The cover 20 further includes an inwardly projecting lip 38 on its lower-inner surface 37 which selectively snap-fits over projecting lip 30 at the upper end 14 of the body 12, as shown in FIG. 3.

As shown in FIGS. 3 and 4, baffle 40 includes an aperture 42, and the baffle 40 is preferably infundibular in shape with the aperture 42 at its lowermost point. The baffle 40 rests upon the upper end 14 of the body 12, shown at 34, such that the aperture 42 of the baffle 40 projects downwardly into the cavity 18 of the body 12 and is the only entrance to the cavity 18 when the cover 20 and baffle 40 are fitted upon upper end 14. The baffle 40 snap-fits within the cover 20 in an annular groove above the inner lip 38, and then the cover 20 with baffle 40 fitted thereto is attached to the upper end 14 of the body 12. When so snap-fitted, the baffle 40 can rotate within the cover 20 such that any member, such as the V-shaped notch of FIG. 4, can be rotated relative to the closure 22. Alternatively, the baffle 40 is held between the cover 20 and the body 12 by the snap-fitting action of the inner lip 38 of the cover 20 fitting over outer lip 30 of the upper end 14 of the body 12. The infundibular shape of the baffle 40 assists in directing the spent smoking materials from tobacco products which have been placed through an open selectively moveable closure 22 of the cover 20 to fall down the baffle 40 through the aperture 42 and into cavity 18 of the body 12 to be retained therein until cover 20 is selectively detached from the body 12 and the spent smoking materials can be emptied therefrom.

The action of the snap-fitting of the cover 20 over the upper end 14 of the body 12, and the baffle 40 within the cover 20 creates a three-layer sandwiching joint and seal 41 which greatly retards any smoke generated by the spent smoking materials being retained within the cavity 18 from escaping the portable repository for spent smoking materials 10. Further, the joint and seal 41 retards air from entering the cavity 18 to foster combustion of smoldering materials contained therein. Thus, the present invention has a distinct advantage over other containers as it minimizes the amount of smoke from the spent smoking materials being held within it from combusting and escaping into the environment and disturbing others.

The specific interrelation of the cover 20, the selectively moveable closure 22 and the baffle 40 are shown in FIG. 4. The selectively moveable closure 22 includes a pair of projections 48 which snap-fit within eyelets 46 on the hemispherical portion 26 of the cover 20 allowing rotation of the selectively moveable closure 22. When so fitted, selectively moveable closure 22 selectively slidably moves within hemispherical portion 26 of cover 20 thereby allowing access to the baffle 40 and the aperture 42. The baffle 40 selectively slidably fits within the lower inner surface 37 of cover 20, and may either snap-fit within the lower, inner surface 37 of cover 20 (not shown), or rest upon the upper end 14 of the body 12, as shown in FIG. 3, being held between the cover 20 and upper end 14 of the body 12 creating a seal by the snap-fitting action of the inner lip 38 on the lower inner surface 37 of the cover 40, and the outer lip 30 on the upper end 14 of the body 12 such that smoke will rise around the infundibular baffle 40 and become trapped at the seal of the baffle 40, upper end 14 and cover 20.

Figure 5:
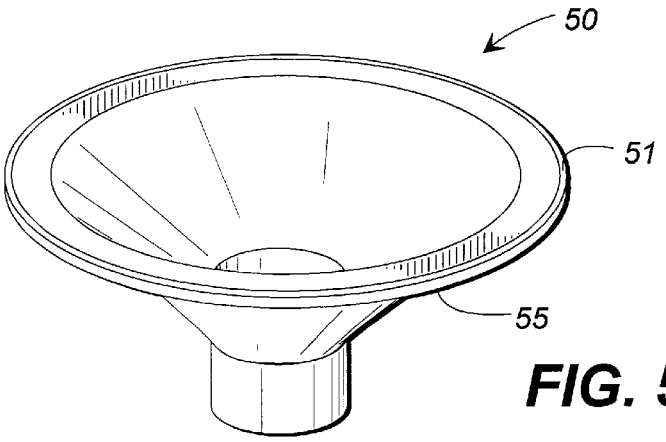
FIG. 5 is an alternate embodiment of the funnel.

FIG. 5 shows an alternate embodiment of the baffle 50. In such embodiment, the outside portion 51 is generally planar and the outer lip 55 rests upon the upper end 14 of the body and held in place by the snap-fitting action of the cover 20.

The portable repository for spent smoking materials 10 may include a V-shaped notch 46 upwardly projecting from the baffle 40 for supporting a tobacco product accessibly positioned within the selectively moveable closure such that spent smoking materials from the tobacco product falls through the aperture 42 of the baffle 40 and into the cavity 18 of the body 12, shown in FIG. 4. It should be apparent that other structures or members can be used in place of the V-shaped notch 46 to accomplish the same function. When the selectively moveable closure 22 is opened, a tobacco product, such as a cigar or cigarette, can be rested upon the V-shaped notch 46 such that the ashes fall down baffle 40 and through aperture 42 into cavity 18 of the body 12. The V-shaped notch 46 is particularly here shown as large enough to accommodate both cigars and cigarette shapes within the taper of the V shape.

Accordingly, a method of storing and disposing of spent smoking materials using the portable repository for spent smoking materials as embodied herein is provided. A person using the portable repository for spent smoking materials 10 opens the selectively moveable closure 22 of the cover 20, places spent smoking materials within the open selectively moveable closure 22 and through the aperture 42 of the baffle 40 to be retained within the cavity 18 of the body 12. When it is desired to clean the portable repository for spent smoking materials 10, or otherwise dispose of the spent smoking materials retained therein, the person selectively detaches the cover 20 from the upper end 14 of the body 12 and empties the cavity 18 of spent smoking materials retained therein. The cover 20 is then be re-attached to the upper end 14 of the body 12 for further usage.

When the portable repository for spent smoking materials 10 is provided with a V-shaped notch 46 projecting upwardly from the baffle 40 (or other like member), to support a tobacco product accessibly positioned within the selectively moveable closure 22 such that spent smoking materials from the tobacco product falls through aperture 42 of the baffle 40 and into the cavity 18 of the body 12, then the method of use further includes the step of placing a tobacco product on the V-shaped notch 46 for supporting a tobacco product (or other like member), such that spent smoking materials from a tobacco product falls through the aperture 42 of the baffle 40 and into the cavity 18 of the body 12.

While there has been shown a preferred embodiment of the present invention, it is to be understood that certain changes, additions, deletions, and alterations in the forms and arrangements of parts may be affected without departing from the underlying ideas or principles of this invention as set forth in the claims appended herewith. In addition, the corresponding structures, materials, acts and equivalents of means or step-plus function elements in the claims are intended to include any structure, material, or act for performing the function in combination with other claimed elements, as specifically claimed herein.

What is claimed is:

1. A portable repository for spent smoking materials, comprising:

a hollow rigid body having an open upper end and a closed lower end, and a cavity within said body between said upper end and said lower end;

a cover including a selectively moveable closure, said cover being removably attached to said upper end of said body; and a baffle including a narrow, permanent aperture therethrough directed into said cavity, said baffle held between said cover and said lower end of said body, and said aperture positioned under said cover and selectively accessible through movement of said selectively moveable closure of said cover, whereby spent smoking materials are inserted through the selectively moveable closure of the cover and the aperture of the baffle to be retained within the cavity of the body.

2. The portable repository of claim 1, wherein said body includes an upper diameter and a lower diameter, and said lower diameter is sized to slidably fit within a standard beverage container holder.

3. The portable repository of claim 2, wherein said lower end of said body is frusto-conical in shape.

4. The portable repository of claim 1, further including means for selective attachment upon a vertically planar extension.

5. The portable repository of claim 4, wherein said means for selective attachment upon a vertically planar extension is an L-shaped projection rigidly attached to said body and extending outwardly therefrom.

6. The portable repository of claim 1, wherein said cover and said baffle are connected to said body in a manner to form a single, multi-detachable connection.

7. The portable repository of claim 1, wherein said baffle is removably attached to said body.

8. The portable repository of claim 7, wherein said body, said cover and said baffle are fire-resistant plastic.

9. The portable repository of claim 1, wherein said baffle is positioned between said cover and said upper end of said body to form a seal to retard smoke from spent smoking materials retained within said cavity from escaping said cavity.

10. The portable repository of claim 9, wherein said baffle is downwardly infundibular with said aperture at the lowermost point of said baffle.

11. A portable repository for spent smoking materials, comprising:

a rigid, generally cylindrical body having an open upper end and a closed lower end, said body having an upper diameter and a lower diameter smaller than said upper diameter, and a cavity within said body between said upper end and said lower end;

a cover including a selectively moveable closure, said cover being removably attached to said upper end of said body;

a baffle including a narrow, permanent aperture therethrough, said baffle being removably attached between said cover and said upper end of said body, said baffle downwardly extending into said cavity of said body, and said aperture positioned under said cover and selectively accessible through movement of said selectively moveable closure of said cover; and said cover, said baffle, and said upper end of said body forming a three-layer sandwiching joint and seal therebetween, whereby spent smoking materials are inserted through the selectively moveable closure of the cover and the aperture of the baffle to be retained within the cavity of the body and said three-layer joint and seal retards air from entering and smoke from escaping the cavity.

12. The portable repository of claim 11, wherein said body further includes means for selective attachment upon a vertically planar extension.

13. The portable repository of claim 12, wherein said means for selective attachment upon a vertically planar extension is an L-shaped extension rigidly attached to said body and extending outwardly therefrom.

14. The portable repository of claim 11, further including means to support a tobacco product accessibly positioned within said selectively moveable closure such that spent smoking material from the tobacco product falls through said aperture of said baffle and into said cavity of said body.

15. The portable repository of claim 14, wherein said means for supporting a tobacco product is a V-shaped notch upwardly projecting from said baffle.

16. A method of storing and disposing spent smoking materials using a portable repository for spent smoking materials, comprising the steps of:

opening a selectively moveable closure of a cover adapted to be selectively detached from the upper end of a hollow rigid body having an open upper end and a closed lower end, the body further having a cavity formed between the upper end and the lower end;

placing spent smoking materials through the open moveable closure and through an aperture of a baffle between the cover and a cavity of the body, the spent smoking materials being retained within the cavity of the body;

selectively detaching the cover from the upper end of the body; and emptying the cavity of the spent smoking materials retained therewithin.

17. The method of claim 16, further including the step of placing a tobacco product on a means for supporting a tobacco product accessibly positioned with the selectively moveable closure such that spent smoking material from the supported tobacco product falls through the aperture of the baffle and into the cavity of the body.

18. The method of claim 17, where the step of placing a tobacco product on a means for supporting a tobacco product is placing a tobacco product on a V-shaped notch upwardly extending from the baffle.

19. The method of claim 16, further including the step of selectively attaching the portable repository to a vertically planar extension.

20. The method of claim 19, wherein the step of selectively attaching the portable repository to a vertical planar extension is selectively attaching an L-shaped extension rigidly attached to the body and extending outwardly therefrom upon a vertically planar extension.

21. A portable repository for spent smoking materials, comprising:

a hollow rigid body having an open upper end and a closed lower end, and a cavity within said body between said upper end and said lower end;

a separate hemispherical cover including a selectively moveable closure, said cover being removably attached to said upper end of said body; and a separate infundibular baffle including a narrow, permanent aperture therethrough directed into said cavity, said baffle held between said cover and said upper end of said body, and said aperture positioned under said cover and being selectively accessible through movement of said selectively moveable closure of said cover, whereby spent smoking materials are inserted through the selectively moveable closure of the cover and the aperture of the baffle to be retained within the cavity of the body.

22. The portable repository of claim 21, wherein said body includes an upper diameter and a lower diameter, and said lower diameter is sized to slidably fit within a standard beverage container holder.

23. The portable repository of claim 22, wherein said lower end of said body is frusto-conical in shape.

24. The portable repository of claim 21, further including means for selective attachment upon a vertically planar extension.

25. The portable repository of claim 24, wherein said means for selective attachment upon a vertically planar extension is an L-shaped projection rigidly attached to said body and extending outwardly therefrom.

26. The portable repository of claim 21, wherein said cover and said baffle are connected to said body in a manner to form a single, multi-detachable connection.

* * * * *